US005152553A

United States Patent [19]

Domingo

[11] Patent Number: 5,152,553

[45] Date of Patent: Oct. 6, 1992

[54] BOOK OPENER

[76] Inventor: Ray Domingo, 316 13th Ave. N., St. Petersburg, Fla. 33701

[21] Appl. No.: 664,559

[22] Filed: Mar. 4, 1991

[51] Int. Cl.[5] ..... B42D 9/00

[52] U.S. Cl. ..... 281/42; 116/237; 116/238; 281/45

[58] Field of Search ..... 116/236, 237, 235, 239; 281/42, 45

[56] References Cited

U.S. PATENT DOCUMENTS

| | | | |
|---|---|---|---|
| 186,382 | 1/1877 | Suter | 281/42 |
| 316,499 | 4/1885 | Thomas | 281/42 X |
| 2,278,143 | 3/1942 | Matthews | 281/42 |
| 3,604,727 | 9/1971 | Wilkin | 116/237 X |
| 3,701,332 | 10/1972 | Brooks | 116/238 |
| 4,024,832 | 5/1977 | Machnikowski | 116/237 |
| 4,908,912 | 3/1990 | Grant | 281/42 X |
| 4,932,680 | 6/1990 | Rivera | 281/42 |
| 4,982,685 | 1/1991 | Abe | 281/42 X |

FOREIGN PATENT DOCUMENTS

| | | | |
|---|---|---|---|
| 3905502 | 8/1990 | Fed. Rep. of Germany | 146/238 |

*Primary Examiner*—Paul A. Bell
*Attorney, Agent, or Firm*—Fay, Sharpe, Beall, Fagan, Minnich & McKee

[57] ABSTRACT

A pocket-sized book opener for holding a book in an open position comprising a page holding apparatus attached to two planes that converge angularly to form a wedge. When the page holding apparatus is removably fastened to the pages on one side of the book, and adjacent to the spine, the wedge is pressed snugly into the spine of the book and holds the book in an open position. The transparent material of the book opener allows the reader to view the written word through the planes of the wedge.

15 Claims, 1 Drawing Sheet

BOOK OPENER

BACKGROUND OF THE INVENTION

1. Field of the Invention

The present invention relates to an apparatus for holding books in an open position so that they may be read by a person without that person's having to hold the book open.

2. Description of the Prior Art

It is possible to keep a book in an open position by placing weights around the edges. However, this is inconvenient as the weights are not very portable nor are they convenient for frequent page-turning as would occur in the normal reading of a book. There are devices which are designed to hold books in an open position. These devices, however, because of their structural design, are too large to be pocket-size.

There have been book opening devices that were essentially oversized paper clips with arms that projected outwardly. When such a device was clipped on to the pages on the left hand side of an open book the protruding arm extended to the right, across part of those pages on the left hand side, continuing across the spine and across a portion of the page on the right hand side. Because of the design of such a device, it had to be made out of relatively heavy gauge wire, which obscured the written words and impeded reading.

There exists a contemporary device for holding a book open which utilizes a transparent, angularly bent strip of resilient plastic. The strip is approximately one and one-half inches wide and essentially wraps around an open book in a horizontal direction, conforming with the angles of the open covers. Each of the two ends of the strip is crimped back in such a way that it overlaps and clamps down on each side of the open book, thus keeping the book open. The sides of this device, at the point where they are crimped, extend well beyond the sides of an open book. It is obviously too large to be pocket size.

Thus, there is a need for a convenient, pocket-sized device to hold a book in an open position, allowing a person to utilize his/her hands for things such as knitting, crocheting, eating, and so forth.

SUMMARY OF THE INVENTION

The present invention relates to an apparatus for holding a book in an open position without the book being held open by a person. The device is small and light in weight so that it may be carried in a pocket or a purse and be removably attached to a book wherever and whenever a convenient time for reading occurs. Most simply stated, the book opener of this invention comprises a wedge formed by two planes converging angularly. To this wedge is attached a page holder for releasably fastening the book opener to pages of a book so that the wedge is forced into the spine of the open book and the opposing pages of the book are held in an open position relative to one another.

The invention is made out of a transparent material and, therefore, does not impede reading by obscuring the written words.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION

Figure 2:
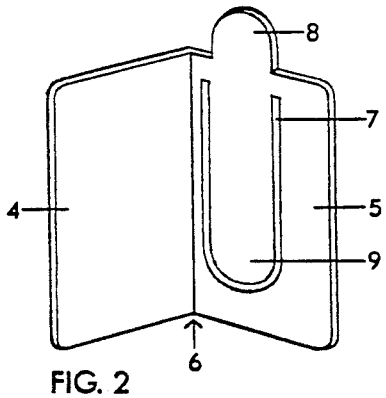
FIG. 2 is the same perspective view of the book opener alone.
Figure 3:
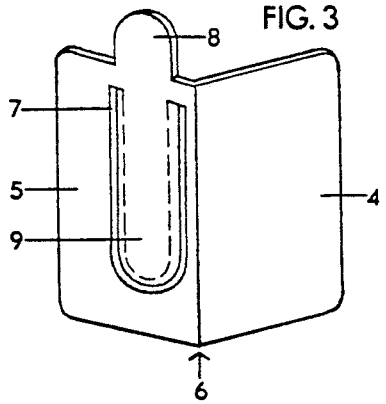
FIG. 3 is a perspective view of the back of the book opener showing the beveled edge of the page holder.

A preferred embodiment of the book opener of this invention is illustrated in the drawing figures. In FIGS. 2 and 3 it can be seen that the book opener comprises a wedge 6, a page holder 9, and a handle 8.

In this preferred embodiment the first plane 4 and the second plane 5 of the wedge 6, meet in an angle of approximately 140 degrees. While a 140 degree angle has been found to be very efficient, lesser or greater angles may be used dependent upon the size and thickness of the book.

The page holder 9 is formed by having a U-shaped slot 7 cut out of the second plane 5 of the wedge 6. The page holder 9 is positioned parallel and adjacent to the corner of the wedge 6. In FIG. 3 it can be seen that the outer edge of the page holder 9 is beveled at an angle of approximately 45 degrees. This beveled edge facilitates insertion of the page holder 9 between the pages of a book 10.

The handle 8 is directly aligned with the page holder 9 giving the user greater ability to move the page holder 9 and the second plane 5 of the wedge 6 apart to develop a torsion force, creating a biasing means.

Figure 1:
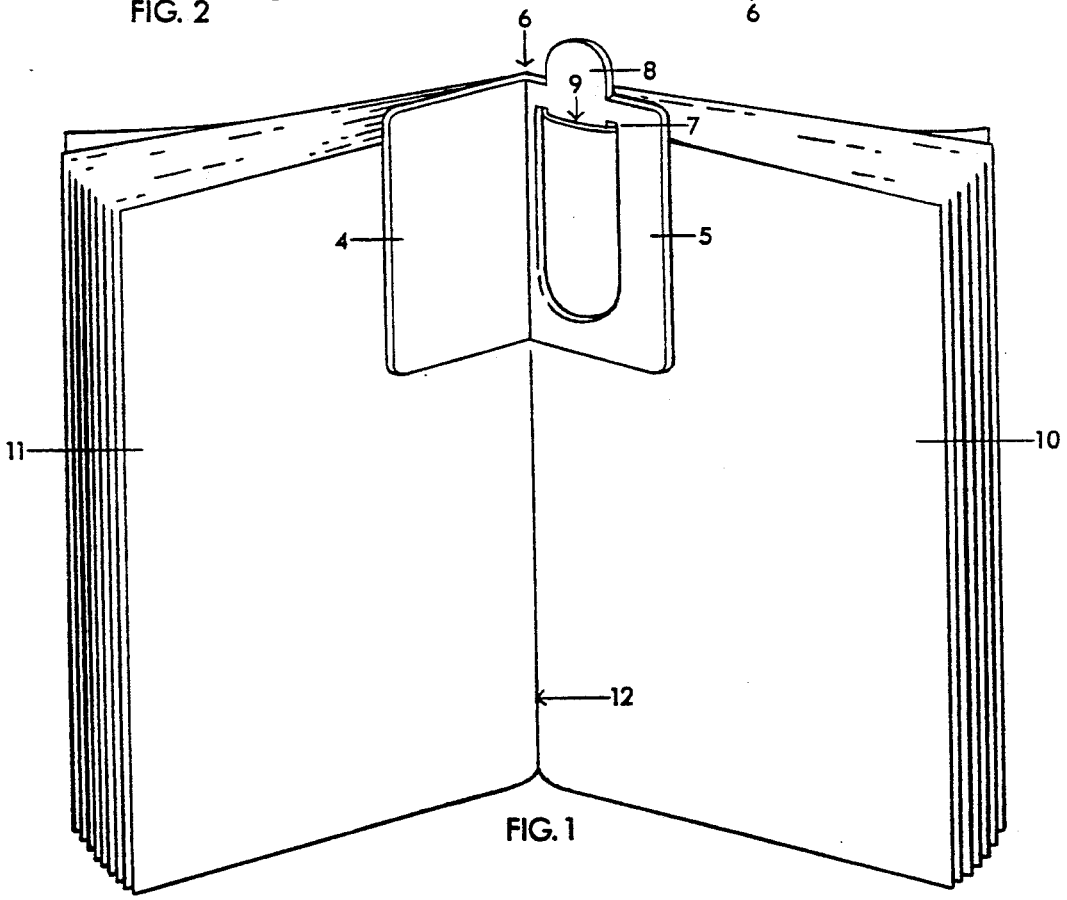
FIG. 1 is a perspective view of the preferred embodiment of the book opener attached to a book.

In the operating position, as shown in FIG. 1, the page holder 9 is inserted into pages of the book 10. The torsion force developed by the separation of the page holder 9 and the second plane 5 removably fastens the book opener to the book. The wedge 6 is forced into the spine 12 of the book. The first plane 4 of the wedge 6 pushes against the first side of the book 11, and the second plane 5 of the wedge 6 pushes against the pages on the second side of the book 10, and thus the book is held in an open position.

Figure 4:
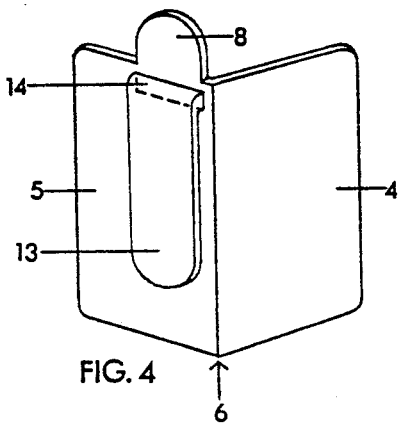
FIG. 4 is a modified form of the book opener wherein the page holding means is a more conventional form of clip Similar reference characters refer to similar parts throughout the several views of the drawings.

FIG. 4 is a modified form of the book opener wherein the page holding apparatus is a more conventional form of clip 13, the perspective being the same as the FIG. 3 illustration of the preferred embodiment. In this modified form, the U-shaped slot 7 is eliminated from the second plane 5 of the wedge 6. The base 14 of the clip 13 is ultrasonically bonded to the back of the second plane 5 of the wedge 6.

The book opener is most practically made by injection molding of a transparent and resilient plastic material. Because it is transparent, it does not obscure the written words and does not impede reading.

Having thus set forth a preferred construction for the book opener of this invention, it is to be remembered that this is but a preferred embodiment. It is intended that all matters contained in the above description as shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A book opener for holding a book in an open position, the opener comprising:

a one-piece, transparent plastic wedge having first and second planar portions secured together along a common, coextensive edge and being disposed at an angle of approximately 140° relative to one another to define a corner adapted for receipt between consecutive, facing pages in a book and the planar portions adapted to lay flush against the consecutive, facing pages; and, a page holder extending only from the first planar portion along an end secured to the first planar portion and having a free, opposed and separated therefrom and adapted for flexing movement toward and away from the first planar portion to selectively capture portions of one or more pages therebetween and secure the opener to a book.

2. The book opener as defined in claim 1 further comprising a handle extending outwardly from adjacent the secured end of the page holder and in a direction opposite the free end of the page holder, the handle being substantially aligned with the page holder to facilitate flexing of the page holder to selectively insert and remove the opener in a book.

3. The book opener as defined in claim 1 wherein the page holder is disposed in a common plane with the first planar portion and separated therefrom by a generally U-shaped slot.

4. The book opener as defined in claim 1 wherein the page holder is offset from the first planar portion and separated therefrom except at its secured end.

5. A book opener for holding a book in an open position, the opener comprising:

a wedge having first and second planar portions secured together along a common edge, the planar portions being disposed at an angle of approximately 140° relative to one another to define a corner adapted for receipt into a spine of a book and the planar portions adapted to lay flush against consecutive, facing pages of a book;

a page holding means extending from the first planar portion and having a free first end adapted to be flexed toward and away from the first planar portion along a second end that secures the page holding means to the first planar portion; and, a handle extending outwardly from the first planar portion in a direction substantially aligned with the page holding means to facilitate insertion and removal of the opener in a book.

6. The book opener as defined in claim 5 wherein the wedge is formed of a transparent material whereby pages of a book are not obscured when the opener is inserted therein.

7. The book opener as defined in claim 5 wherein the page holding means is disposed in a common plane with the first planar portion and separated therefrom by a generally thin, U-shaped slot.

8. The book opener as defined in claim 5 wherein the page holding means is offset from the first planar portion and separated therefrom except as its second end.

9. The book opener as defined in claim 5 wherein the first end of the page holding means is beveled to facilitate insertion between pages of a book.

10. The book opener as defined in claim 5 wherein the page holding means is spaced from and parallel to the corner.

11. A book opener for holding a book in an open position, the opener comprising:

a one-piece, transparent plastic wedge having first and second planar portions extending away from one another at an angle between 90°-180° along a common edge to define a corner;

a page holder extending only from the first planar portion, the page holder having a first end separated from the first planar portion for flexing movement toward and away therefrom about a second end integrally secured to the first planar portion, the page holder extending substantially parallel to and offset from the corner; and, a handle extending outwardly from the first planar portion at a region adjacent the page holder second end and in a direction opposite the first end of the page holder.

12. The book opener as defined in claim 11 wherein the page holder is normally disposed in an unflexed state in a plane common with the first planar portion.

13. The book opener as defined in claim 12 wherein the page holder is separated from the first planar portion by a generally U-shaped slot.

14. The book opener as defined in claim 11 wherein the page holder is offset from the first planar portion and separated therefrom except at its second end.

15. The book opener as defined in claim 11 wherein the first and second planar portions are disposed at an angle of approximately 140° relative to one another.

* * * * *